US007115044B2

(12) United States Patent
Faltin

(10) Patent No.: US 7,115,044 B2
(45) Date of Patent: Oct. 3, 2006

(54) MAGNETIC MODULE GOLF SWING LEARNING, TRAINING, AND PRACTICE DEVICE

(76) Inventor: George Jurgen Faltin, 7 Morningside Ct., Lakewood, NJ (US) 08701

( * ) Notice: Subject to any disclaimer, the term of this patent is extended or adjusted under 35 U.S.C. 154(b) by 0 days.

(21) Appl. No.: 10/934,008

(22) Filed: Sep. 3, 2004

(65) Prior Publication Data

US 2006/0052175 A1 Mar. 9, 2006

(51) Int. Cl.
*A63B 69/36* (2006.01)

(52) U.S. Cl. ..... 473/266; 473/278; 473/501; 273/417; 273/420; 273/456

(58) Field of Classification Search ..... 473/132, 473/137, 206, 407, 420, 501, 266, 278; 273/456, 273/417, 420
See application file for complete search history.

(56) References Cited

U.S. PATENT DOCUMENTS 3,844,565 A * 10/1974 Gigliotti ..... 473/159
3,862,756 A * 1/1975 Selliken ..... 473/501
3,891,221 A * 6/1975 Gordon ..... 473/174
4,690,403 A * 9/1987 Meggs ..... 473/501
5,102,129 A * 4/1992 Roberts ..... 473/414
5,564,695 A * 10/1996 Christensen ..... 473/501

* cited by examiner

*Primary Examiner*—Nini F. Legesse
(74) *Attorney, Agent, or Firm*—Michael I. Kroll

(57) ABSTRACT

The present invention is a Golf learning, training, practice device utilizing a Magnetic Module, Swing Plate, Impact Form, and Ball Holder. The Magnetic Module is a shallow case enclosing a plurality of magnets, inserted flush with earth ground, or a board. The Swing Plate is a round or elongated disk with a plurality of apertures from left side to right, having printed location guides for ball or target positioning, used by laying selected aperture onto Magnetic Module. The Impact Form of a shape, of resilient material, or fabric becoming a target for practice golf swing. The Ball Holder, a form or shape, of resilient material, being concave, or cylindrical on top, to support a real, or practice golf ball. The selected aperture of Swing Plate, magnetically attracted to Magnetic Module, will also, within the same aperture, attract either Impact Form or Ball Holder. This device offers ball placement choices, swing approaches, orientation, and guidance, for practice swings and actual strokes with a golf ball.

4 Claims, 6 Drawing Sheets

Golf Magnetic Module
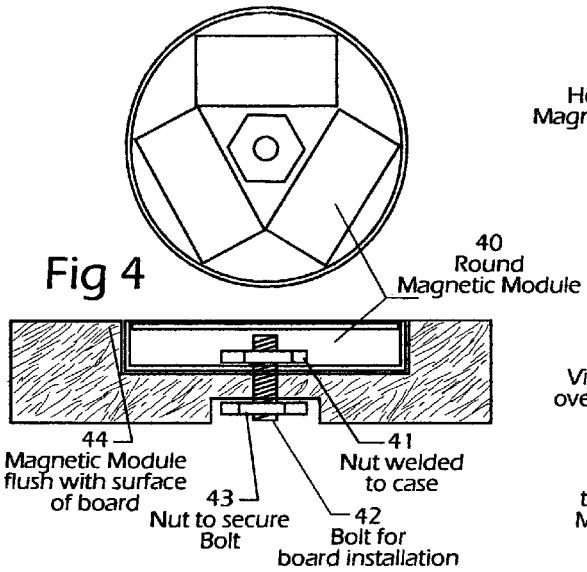
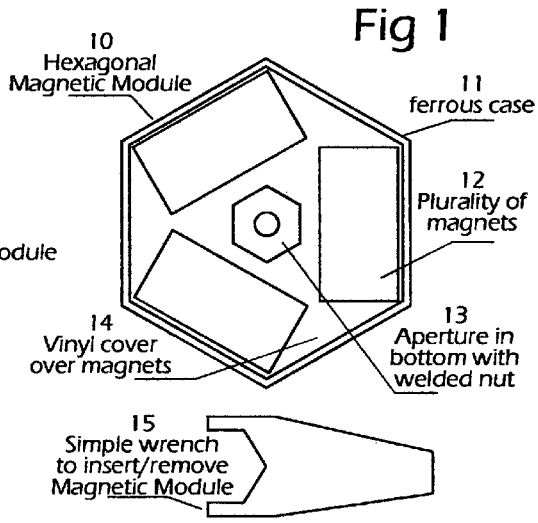
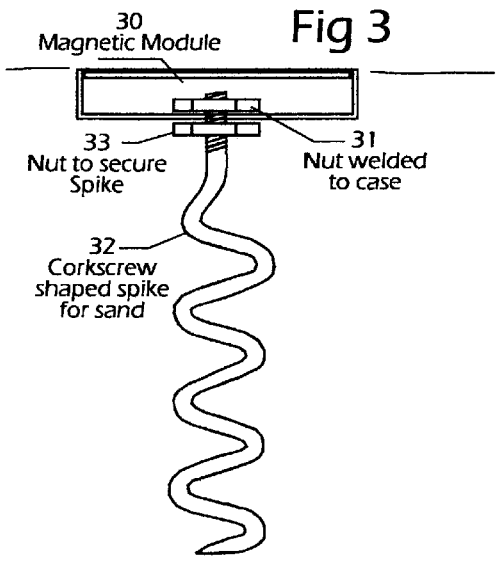
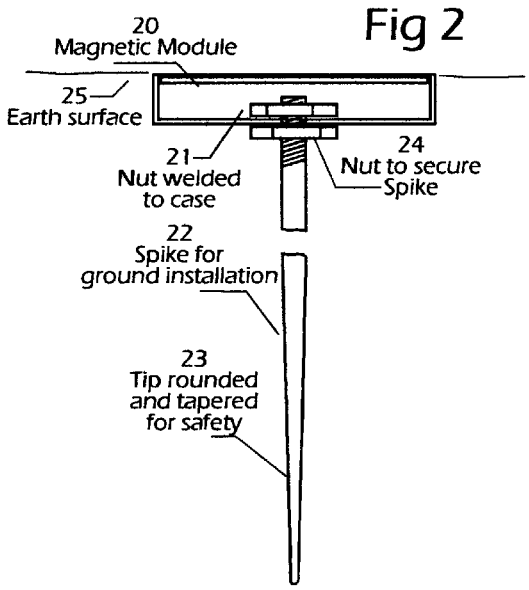

Golf Magnetic Module

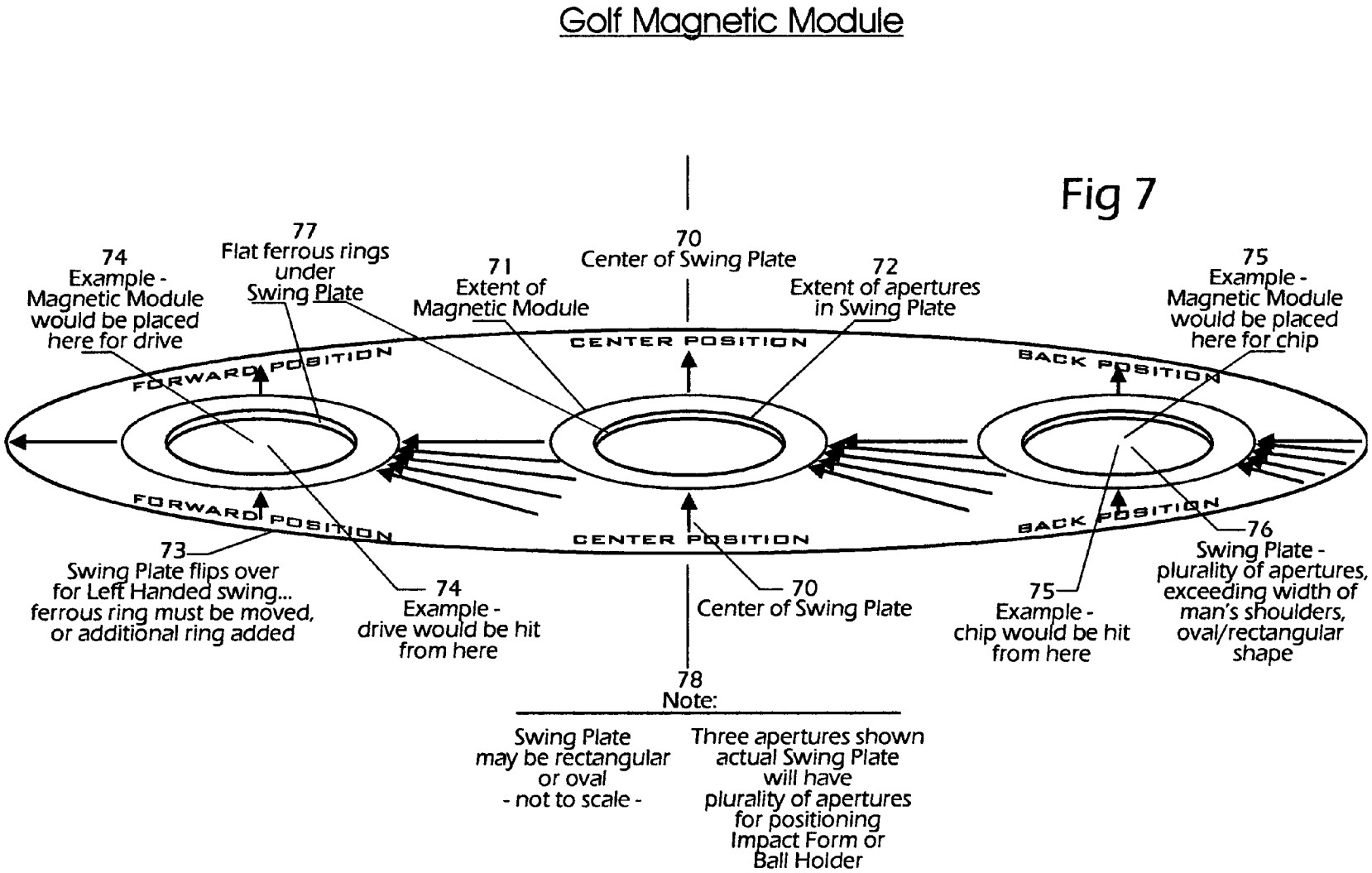
Golf Magnetic Module
Fig 7
BACK POSITION
CENTER POSITION
FORWARD POSITION
75 Example - Magnetic Module would be placed here for chip
76 Swing Plate - plurality of apertures, exceeding width of man's shoulders, oval/rectangular shape
75 Example - chip would be hit from here
72 Extent of apertures in Swing Plate
70 Center of Swing Plate
70 Center of Swing Plate
71 Extent of Magnetic Module
74 Example - drive would be hit from here
77 Flat ferrous rings under Swing Plate
74 Example - Magnetic Module would be placed here for drive
73 Swing Plate flips over for Left Handed swing... ferrous ring must be moved, or additional ring added
78 Note:
Swing Plate may be rectangular or oval - not to scale -
Three apertures shown actual Swing Plate will have plurality of apertures for positioning Impact Form or Ball Holder Golf Magnetic Module
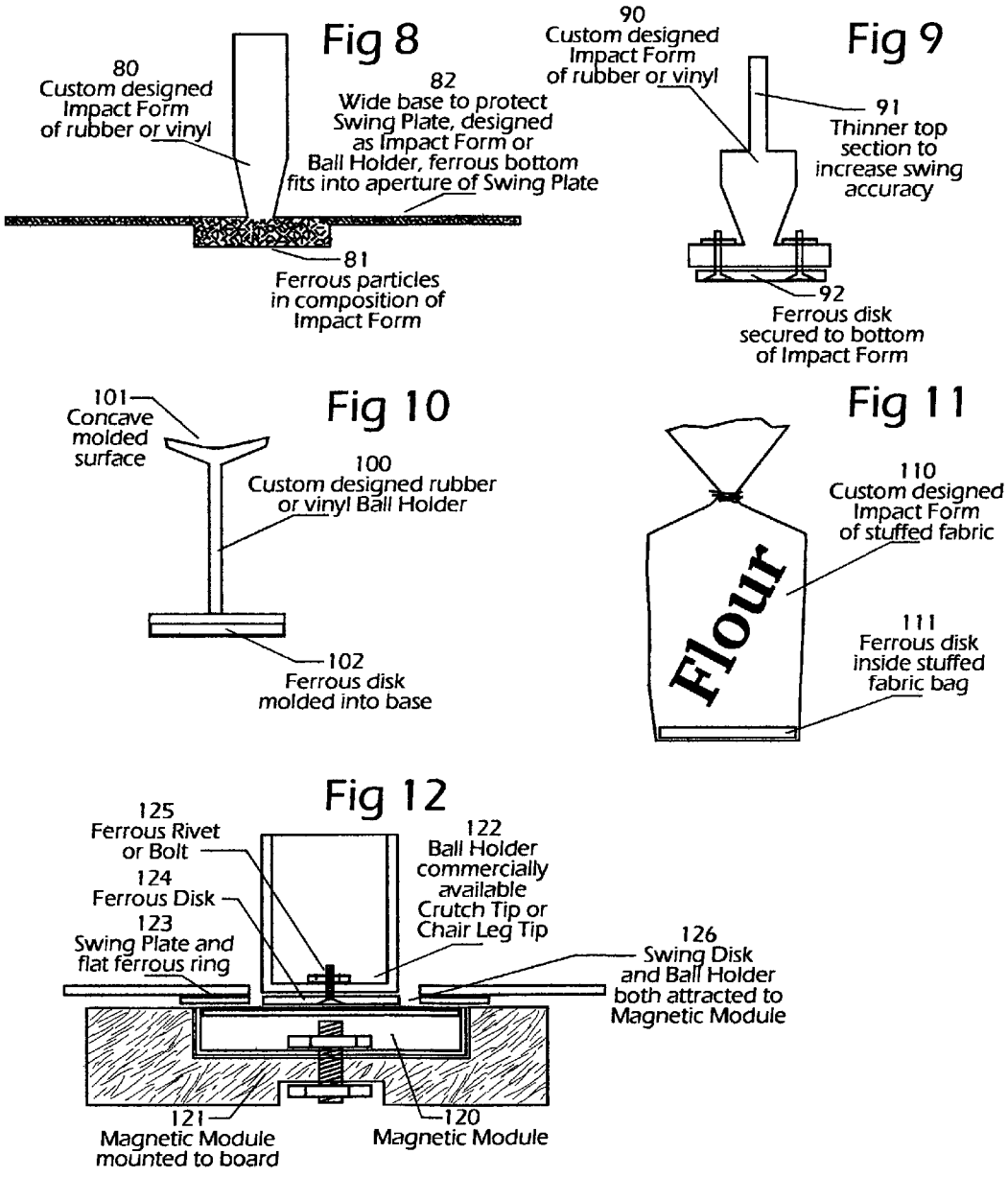

Golf Magnetic Module
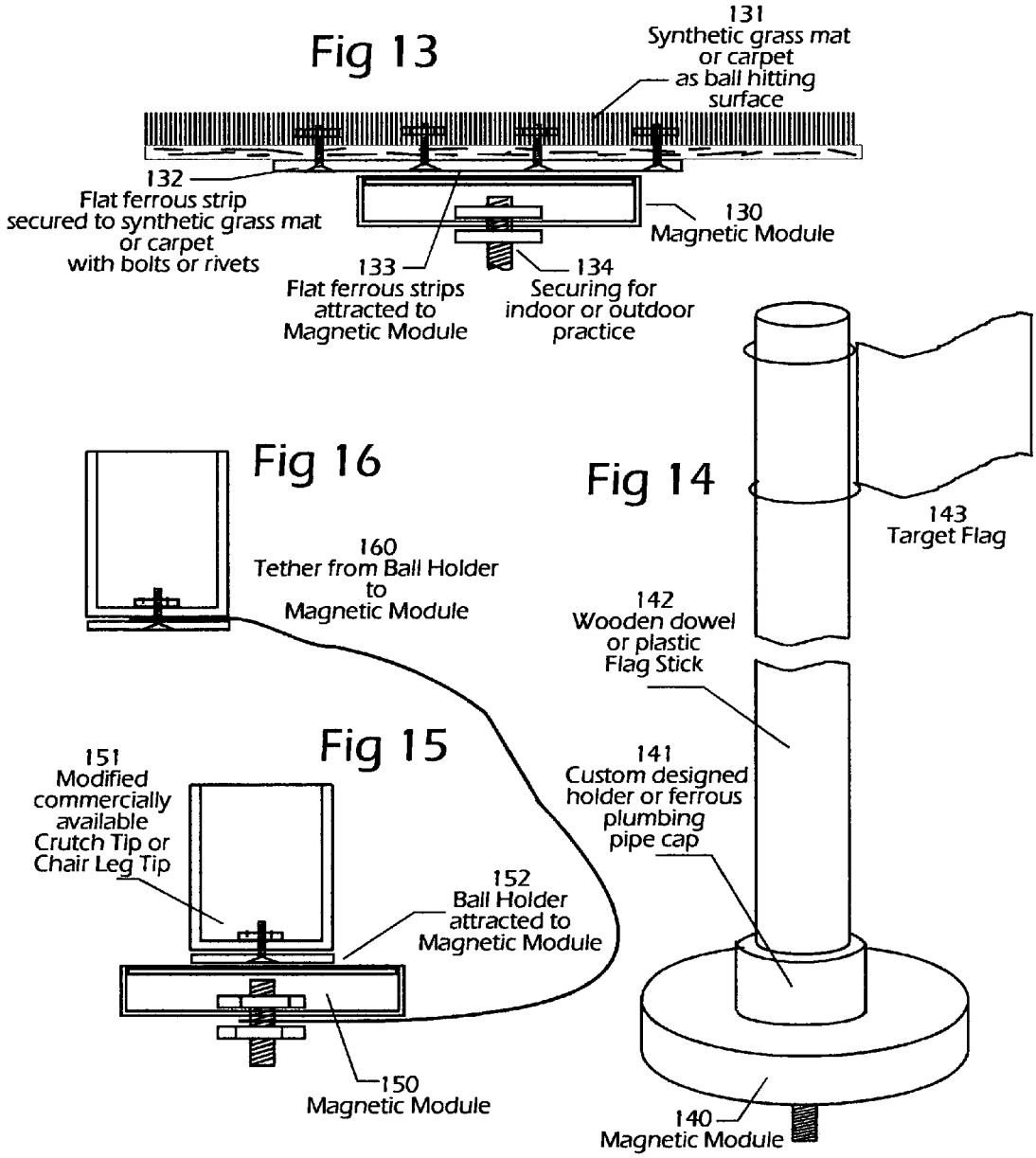

Golf Magnetic Module

MAGNETIC MODULE GOLF SWING LEARNING, TRAINING, AND PRACTICE DEVICE

BACKGROUND OF THE INVENTION

1. Field of the Invention

This invention relates generally to the field of Sports and more specifically to Golf Swing improvement by the use of Magnetic Module Golf Swing Learning, Training, and Practice Device.

The golf learning tool came from my own attempt at learning the golf swing. I have practiced at a driving range, and in my own back yard. I found that at the driving range, I was bouncing the club off the mat before hitting the ball, and at home, I was tearing up the grass in my attempts at developing a good swing.

I thought that if I could use a golf tee in the grass, possibly I wouldn't tear up the grass. The tee helped, but it always broke, or got lost in the grass. I tried using the rubber tees from the driving range . . . they were better than the wood tees, but still flew off when I hit them at the same time as the ball. I use wiffle balls to practice with.

I thought about it again, and came up with the idea of magnetism. I used magnets, and fastened an iron washer to the bottom of the rubber tee. I secured the magnet to the ground, put a tee on it and tried it. It worked great . . . the tee usually maintained magnetic attraction to the base, but I still damaged the grass, either by hitting it with the club, or just by the tee scraping the ground. That led me to the concept of a round disk between the magnet and the tee. It didn't work . . . the magnetism was not strong enough to go through the disk and to hold the tee.

I figured out that if I could use the same magnet to hold the disk (non ferrous), but with a cutout hole, and a ferrous ring on the perimeter of the hole, and then set a rubber cane tip, with a ferrous base into the same hole, it might work. It did. I could hit the ball, protect the grass, and also not have to search for the tee after each hit.

That took me to the next idea, if I could have the disk elongated, or rectangular, I could set many holes, for various swing positions, and try to learn to swing at each of them, to develop different swings, and to use different clubs.

The idea works. . . . The cane tip tee and the disk have protected the grass. When I swing too low, I knock out the cane tip, or just hit the disk, but after much practice I have been able to swing at many balls without hitting the disk, or dislodging the cane tip tee. I'm getting better, I have not mastered all the swings from each hole . . . but, I have learned to hit the ball, and mostly have it go straight, and far . . . mostly, not always.

Now I just need a tether on the cane tip, and on the wiffle ball.

2. Prior Technology

The Golf Mat at the driving range works well . . . I believe that if I swung at a ball as often, or as regularly, as I do in my back yard, I would be hitting just as well as I am now doing. . . . Perhaps better, because I would use regular golf balls, and not have to retrieve them.

But, I don't go to the driving range that often, I wouldn't practice chips or pitches, because most of the time at a driving range I just try to blast the ball.

Necessity, they say, is the mother of invention. Just wanting to swing, wanting to get better, wanting to hit different shots, and not wanting to do damage to the grass, and to practice when I want too, for as few, or many, minutes as I want . . . created the need for me to try something.

3. Description of the Prior Art

Prior technology using a wooden tee in grass, or a rubber tee in a mat, both work well. My claim does not try to negate either of the existing systems. My device is a learning tool, where one can practice different type of strokes, different stances, different clubs in different positions using the learning, training and practice tool.

I have looked at many golf patents and I have not found any that have utilized magnetism to attract and hold a learning and guidance plate or a selectively placed swing target on said plate, or a selectively placed golf ball support on said plate, or to hold a mat or carpet in place while putting, pitching, or chipping.

SUMMARY OF THE PRESENT INVENTION

This invention is a learning and practice tool with the objective of improving a golfer's skill, technique, stance, body location, body movement, swing aim, swing approach, impact, swing conclusion after impact . . . and lastly, to be a tool from which, and with, to practice many golf shots.

The concept of finding a way to hit a golf ball better has been an unending experiment, it has been the livelihood of many a teacher, it has been the subject of endless hours at a driving range, it has been the cause of endless frustration on a golf course.

No tool or training system will eliminate all golf learning problems, but this invention, which uses a Magnetic Module unit inserted into the ground, or into a board, enables the golfer to select a certain type of potential golf hit by placing a golf ball on a specially designed Swing Plate, which is magnetically attracted to the Magnetic Module unit, and containing hints, markings, and guides, as to where to place the ball, what club to use, where to stand to make the hit, and how to direct the club to hit from that position.

Further, this invention uses an Impact Form, or a Ball Holder, which is placed into the selected aperture of the Swing Plate, and the Impact Form or the Ball Holder is simultaneously attracted to the Magnetic Module unit with said Swing Plate. It is portable so it can be set up indoors on a board or mat, or outdoors on grass, dirt, or sand. It may be used to practice with a swing target, a wiffle ball, or a golf ball. It has no moving parts, and does not require electric power.

The Magnetic Module unit can be used to hold a synthetic grass mat for putting or chipping, or an Impact Form such as a fabric bag for a young person to learn to swing a golf club, or a Ball Holder to hit at a golf ball, or, if putting, can be set up to hold a target flag on a dowel or stick.

The primary object of this invention is to create a versatile, practical, simple, economical, self motivating, interesting, helpful, and useful tool, to anyone who can use golf training and swing practice, as often as they find it necessary.

Another object of this invention is to encourage the golfer to swing the golf club smoother, with rhythm, ease, and accuracy.

Additional objects are:

to help improve the swing to hit a golf ball straighter;

to help learn how to hit a golf ball longer;

to help learn to hit the ball so it goes up into the air; and to help learn how to hit a chip or pitch Another object is to make a golf learning tool that is portable.

A further object is to make a golf learning tool that can be used indoors or outdoors.

Yet another object is to make a tool that is easy to set up for practice.

A still further object is that this tool will help a child learn the golf swing.

Still another object is to have a golf practice tool which holds a golf (wiffle, foam or regular) ball, lets one swing the club to hit the ball, usually does not require retrieving the tee, and does not destroy the grass.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWING FIGURES

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a plan view of Magnetic Module in a Hexagonal configuration, it shows an arrangement of magnets, the mounting nut on the bottom, indicates the vinyl cover over the magnets, and the wrench to install and remove the Magnetic Module from hard ground.

FIG. 2 is a side view of Magnetic Module and spike used to hold Magnetic Module to the surface of the ground, showing taper of spike, and method of fastening.

FIG. 3 is a side view of Magnetic Module and corkscrew spike used to hold Magnetic Module into sand.

FIG. 4 is a plan view of Magnetic Module in round configuration, showing arrangement of magnets, mounting nut on bottom, also side view showing Magnetic Module secured to a board

FIG. 7 is a perspective view of elongated Swing Plate showing three apertures and flat ferrous rings, markings and guides, and extent of Magnetic Module and attraction of any aperture of Swing Plate to top surface of said Magnetic Module.

FIG. 8 is a side view of design example of Impact Form, which is used as a target for learning to swing a golf club, and how, with Swing Plate as a guide to approach the target of the stroke, also indicating ferrous particles in its composition used to attract to Magnetic Module, and wide base concept to protect surface of Swing Plate.

FIG. 9 is a similar design example of Impact Form as FIG. 8, but showing a different shape, and flat ferrous disk attached to its bottom.

FIG. 10 is an example design for Ball Holder, showing flat ferrous disk molded into bottom.

FIG. 11 is an example of Impact Form using a fabric bag type of target, with a ferrous disk inside the bag, and a stuffed bag to make target for swing.

Note: This is shown to illustrate that a child learning to swing a golf club would find it challenging and enjoyable to hit at something other than a ball at this stage of development FIG. 12 is a side view of Board, Magnetic Module, Ball Holder, and Swing Plate; showing how Magnetic Module will attract said Swing Plate, and Ball Holder, simultaneously.

FIG. 13 is an illustration of Synthetic Grass Mat, or Carpeting, with flat ferrous strip attached to its underside, magnetically attracted to Magnetic Module, for indoor or outdoor practice.

FIG. 14 is an illustration of a ferrous plumbing pipe cap, attracted to Magnetic Module, used as post hole for wood dowel, or plastic stick, and flag target.

FIG. 15 is a Ball Holder attracted directly to top of Magnetic Module as golf ball support.

FIG. 16 is an illustration of a tether that may be attached to Ball Holder or Impact Form to aid retrieval.

Figure 17:
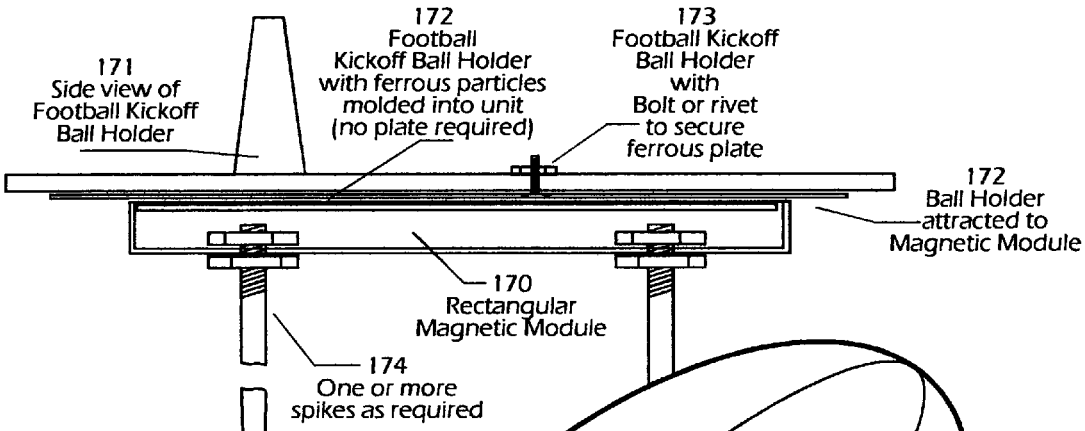

FIG. 17 is an illustration of a Football Kickoff Ball Holder (example design and concept) and rectangular Magnetic Module, with two spikes to secure to ground.

Figure 18:
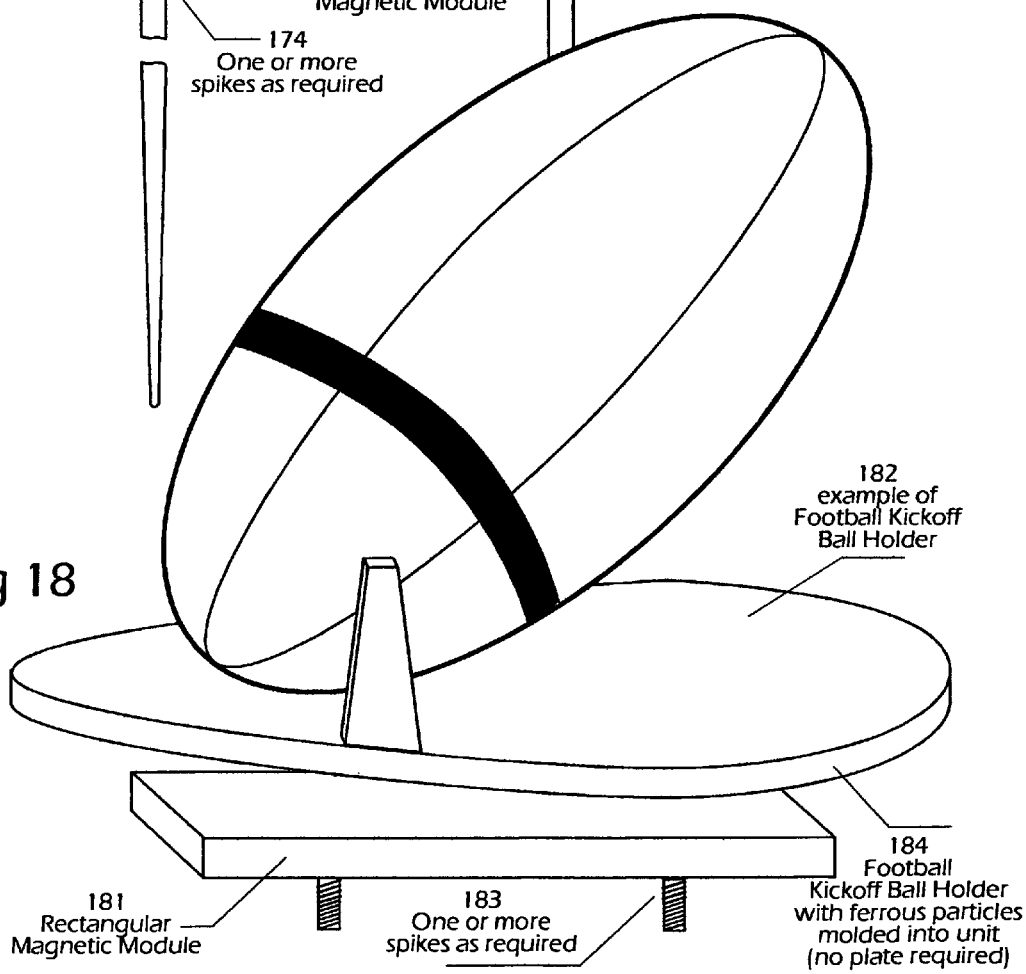

FIG. 18 is a perspective view of an example design and concept for a Football Kickoff Ball Holder and Magnetic Module

DESCRIPTION OF THE REFERENCED NUMERALS

Turning now descriptively to the drawings, in which similar reference characters denote similar elements throughout the several views, the Figures illustrate the system for locating an individual of the present invention. With regard to the reference numerals used, the following numbering is used throughout the various drawing figures.

10 hexagonal magnetic module
11 ferrous case
12 magnets
13 welded nut
14 vinyl cover
15 wrench
20 magnetic module
21 welded nut
22 tapered spike
23 tapered spike rounded tip
24 securing nut
25 earth surface
30 magnetic module
31 welded nut
32 corkscrew spike
33 securing nut
40 magnetic module
41 welded nut
42 threaded bolt
43 securing nut
44 board
50 magnetic module
51 swing plate
52 ferrous ring
53 fastener
54 magnetic attraction
55 ferrous ring
60 swing plate
61 swing plate aperture
62 periphery of magnetic module
63 swing plate aperture wall
64 periphery of ferrous ring

65 ferrous ring
66 indicia
67 right-handed swing indicia
68 left-handed swing indicia
70 swing plate center line
71 periphery of magnetic module
72 swing plate aperture wall
73 flippable swing plate with movable ferrous ring
74 magnetic module drive position
75 magnetic module chip position
76 swing plate aperture
77 ferrous ring
80 rubber or vinyl impact form
81 embedded ferrous particles
82 impact form base
90 rubber or vinyl impact form
91 impact form post
92 impact form ferrous disk
100 rubber or vinyl ball holder
101 ball holder concave receiver
102 ball holder ferrous disk
110 fabric bag impact form
111 fabric bag ferrous bag
120 magnetic module board
121 ball holder receptacle
122 swing plate and ferrous ring
123 ferrous disk
124 ferrous bolt or rivet
125 magnetically fastened ferrous disk and ball receptacle
130 magnetic module
131 synthetic mat or carpet
132 ferrous strip
133 magnetically fastened ferrous strip and magnetic nodule
134 anchoring fastener
140 magnetic module
141 holder
142 wood or plastic flag pole
143 target flag
150 magnetic module
151 ball holder receptacle
152 magnetically fastened ball holder to magnetic module
160 ball holder tether
170 rectangular magnetic module
171 football kickoff ball holder
172 embedded ferrous particles

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The following Figures show the elements comprising the golf swing learning, teaching, and practice device. The Figures also show embodiments which will add to the flexability of the invention, and may stand with the Magnetic Module as the basis for additional claims, as enumerated in the claims section.

Referring to FIG. 1, shown is the Magnetic Module, the integral part of a learning, practice, teaching, device, having the property of attracting, holding and securing components which will enhance, and expand the learning experience, as well as being a component of a Golf Ball teeing device. (a further embodiment, Football Kickoff Ball Holder) (10) having a shallow round, or multifaceted, or rectangular shaped case is used, that contains a plurality of magnets. Hexagonal, as in this example, so a wrench could be used to ease insertion and removal from the ground. The ferrous case (11) form means for attachment of magnets attached thereto and contained therein with the plurality of magnets (12) depending on the case (11) size and number of facets with as aperture (13) in the center bottom with a welded nut to secure a chosen stem to the ground or a board. Vinyl or plastic cover (14) enclose the magnets with wrench (15) wrench to assist in installation and removal from the ground.

Referring to FIG. 2, shown is a typical ground installation. Illustrated is side view (20) of the Magnetic Module with spike and securing method. The Magnetic Module has threaded nut (21) welded inside case forming means for attachment of spike (22) fabricated from metal or plastic, in one or two sections having a tapered shape and rounded tip (23) with a second nut (24) to secure spike. Also shown, is Magnetic Module flush to earth surface (25).

Referring to FIG. 3, shown is an alternative installation for sand. Illustrated is side view (30) of Magnetic Module with corkscrew spike as the securing method. The Magnetic Module has threaded nut (31) welded to inside case forming means for attachment of spike (32), an example of a shape of a corkscrew spike with a second nut (33) to secure the corkscrew spike.

Referring to FIG. 4, shown is a portable indoor installation for Golf practice. Shown is plan and side view of round Magnetic Module (40), and bolt securing method, for installation on board having pre drilled holes. The Magnetic Module has threaded nut (41) welded inside case forming means for attachment of blot (42) to secure Magnetic Module to board using nut (43) at bottom of bolt to hold Magnetic Module to board, which is illustrated having the Magnetic Module flush with surface of board (44).

Figure 5:
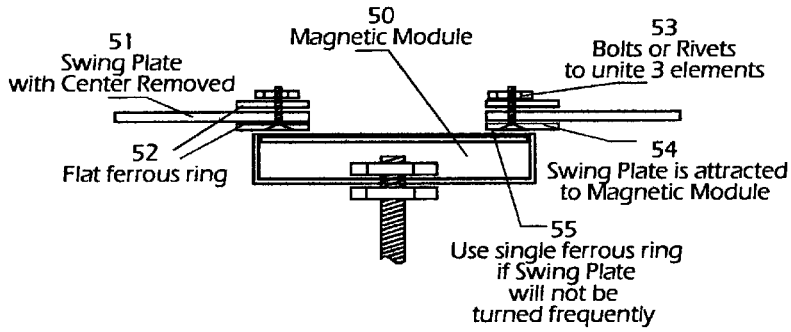
FIG. 5 is a side view of round Swing Plate, using single aperture and flat ferrous ring, to attract said Swing Plate to Magnetic Module.
Figure 6:
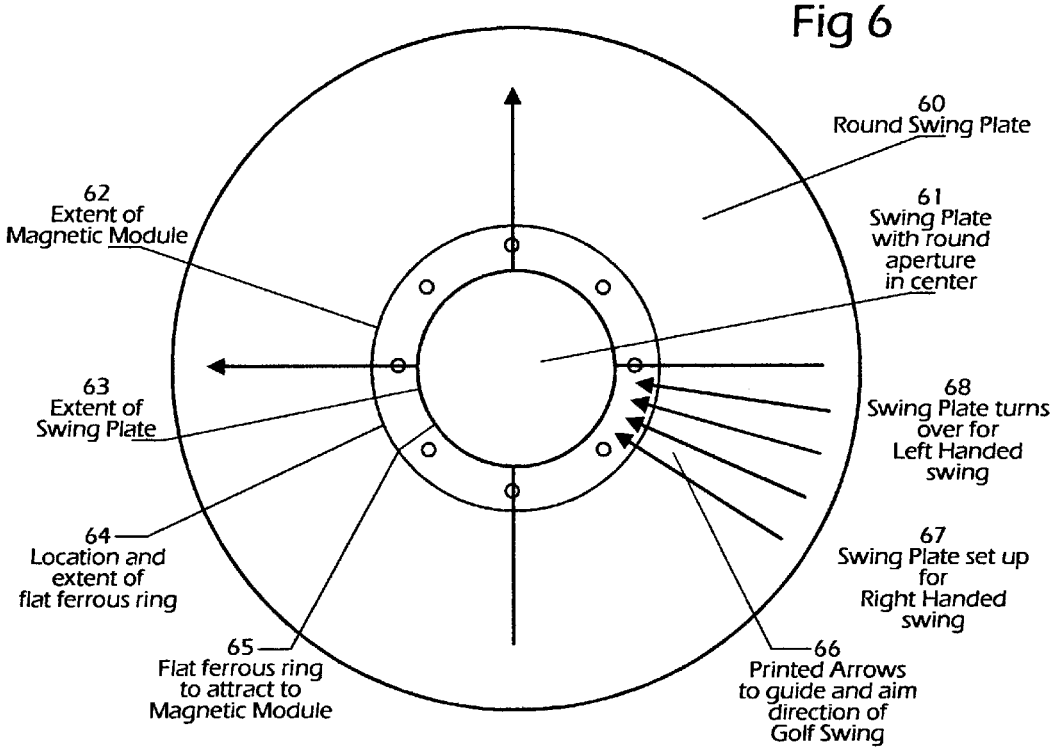
FIG. 6 is a plan view of round Swing Plate, with example of markings, and guides, also how flat ferrous ring under Swing Plate uses outside periphery of Magnetic Module for magnetic attraction.

Referring to FIG. 5, shown is a Swing Plate, a component having apertures, printed markings, and hints to help with the instruction of Golf, and learning, training, and practice, and which may be made of resilient rubber, or plastic, or a composition of impact resistant materials, or even of aluminum. The Swing Plate will inform and help to learn, but it will also help protect the surrounding grass from being destroyed during practice. Illustrated is side view (50) of the Magnetic Module and Swing Plate with (51) a section of the Swing Plate showing center aperture section removed. Also shown is flat ferrous ring (52) with the same diameter aperture as the Swing Plate using bolts or rivets (53) to unite flat ferrous ring and Swing Plate having magnetic attraction (54) of Swing Plate to outer periphery of Magnetic Module, round or hexagonal, or rectangular shapes work best, less facets would not provide sufficient magnetic attraction, and more attraction can be satisfied with octagonal or round shape. The Magnetic Module has threaded nut (21) welded inside case forming means for attachment of spike (22) fabricated from metal or plastic, in one or two sections having a tapered shape and rounded tip (23) with a second nut (24) to secure spike. Also shown, is Magnetic Module flush to earth surface (25). Use one ring, or two if Swing Plate frequently will be turned over, magnetic attraction is not sufficient to go through the Swing Plate Referring to FIG. 6, shown is a Swing Plate from the top. (60) is a top plan view of a round Swing Plate having (61) aperture in center placed over Magnetic Module with (62) as the extent of Magnetic Module whereby (63) is the overlap of Swing Plate onto surface of Magnetic Module and (64) the extent and overlap of flat ferrous ring onto Magnetic Module. Resulting in (65) Swing Plate and flat ferrous rings attracted to outer periphery of Magnetic Module, with (66) printed guide markings, arrows, and hints for orientation, stance, and positioning. As aforementioned the Swing Plate serves left or right handed swing, with (67) set up for Right Handed swing and (68) having the same markings on other side for Left Handed swing Referring to FIG. 7, shown is an oval, rectangular, or elongated Swing Plate. Shown is view of extended Swing Plate (70) showing markings and guides for orientation, stance, and positioning, with (71) depicting the extent of the Magnetic Module and (72) the extent of a respective aperture. Serving left and right handed swing, (73) ferrous ring to be moved or additional ring needed. aforementioned apertures are positioned for various club types, (74) is an example of aperture and Magnetic Module location for a drive position, while (75) is an example of aperture and Magnetic Module location for a chip shot, with (76) a plurality of apertures positioned for different types of strokes, and Swing Plate widths. Also shown are flat ferrous rings (77) under Swing Plate. (78) Note: as illustrated, Swing Plate is not to scale, or proportion.

Referring to FIG. 8, shown is an Impact Form to hit at for Golf Swing. Illustrated is side view (80) of example of custom design (82) Impact Form or Ball Holder of rubber or vinyl having a wide base to protect the Swing Plate and wide stepped base offers stability and locks into aperture using bottom portion (81) that may have ferrous particle composition.

Referring to FIG. 9, shown is another Impact Form for Golf Swing. Shown is side view (90) of an example of a custom design (90) manufactured of rubber or vinyl comprising an elongated upper section (91), to create a more difficult target for a practice swing having ferrous disk attached to bottom (92).

Referring to FIG. 10, shown is an example of Ball Holder for Golf Ball. Depicted is a side view of example of Custom designed rubber or vinyl Ball Holder (100) designed with concave molded surface (101) and ferrous disk molded into base (102).

Referring to FIG. 11, shown is a Fabric Sack Impact Form for Golf Swing. Shown is (110) a view of an example design of Custom Fabric bag, as a target for Golf Swing, which could be used as an interesting target for a beginner, or for a child learning to swing a Golf club. Also shown is (111), a ferrous disk positioned inside bottom of stuffed fabric sack Referring to FIG. 12, shown is the Board, Swing Plate, Magnetic Module, and Ball Holder in (120) a view of Magnetic Module having (121) Magnetic Module flush with top surface of board with Ball Holder (122) comprising a modified chair leg tip. Also shown is Swing Plate and flat ferrous ring (123), flat ferrous disk under Ball Holder (124), nut and bolt, or rivet securing ferrous disk (125) and the magnetic attraction (126) between the Swing Plate and Ball Holder (126) by simultaneous attraction to the Magnetic Module Referring to FIG. 13, shown is practice on mat or carpet indoors with foam balls, or outdoors with regular Golf Balls. Illustrated is side view (130) of Magnetic Module comprising (131) section of synthetic grass mat or carpet; (132) flat ferrous strip secured to mat or carpet; (133) flat ferrous strip attracted to Magnetic Module and (134) securing spike, bolt, or corkscrew spike.

Referring to FIG. 14, shown is the Magnetic Module and Flag (140) for putts, chips, or pitches comprising (141) ferrous plumbing pipe cap magnetically attracted to Magnetic Module wherein (142) ferrous plumbing pipe cap holds wooden dowel or plastic stick with (143) target flag or marker attached thereto.

Referring to FIG. 15, shown is a side view of a Ball Holder and Magnetic Module. Illustrated is a Ball Holder (151) comprising a commercially available crutch tip or chair leg tip having a magnetic element attached thereto whereby the Ball Holder is magnetically fastened to the Magnetic Module (150) at mating surfaces (152).

Referring to FIG. 16, shown the Ball Holder having a magnetic member attached to its base with a tether positioned therebetween (160) whereby the Ball Holder is restricted in travel to the length of the tether.

Referring to FIG. 17, shown is an example application design for a Football Kickoff Ball Holder. Depicted is (171) a side view of example Kickoff Ball Holder comprising rectangular Magnetic Module (170), base of Kickoff Ball Holder with integral ferrous particles (172), base of Kickoff Ball Holder with secured ferrous plate (173) and multiple spikes to secure Magnetic Module (174).

Referring to FIG. 18, shown is a perspective view of Kickoff Ball Holder example design comprising rectangular Magnetic Module (181) having appropriate anchoring members (183) separated from example of Football Ball Holder (182) showing ferrous base of Ball Holder, but with ferrous particles molded into the unit (no plate required).

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A golf swing training Magnetic Module providing a magnetic surface for attachment of appropriate components, and accessories to be magnetically attracted thereto comprising:

a) i) a shallow housing incorporating a ferrous component for its magnetic potential;

ii) a plurality of magnets confined within said housing;

iii) said magnets having a top surface protective member that is a vinyl cover serving as the protective element;

iv) said housing manufactured in a shape taken from the list of round, rectangular, and multifaceted;

v) said housing incorporating a threaded securing means fastenable to an anchor selected from the list of stake, corkscrew and board, with the board primarily for indoor use and the stem-like anchors forming means for attachment to the ground; each designed to selectively hold said housing immobile during use;

b) a Swing Plate comprising:

i) a housing having a plate-like shape wherein the housing could be round, oval, or rectangular;

ii) said housing material could be made out of vinyl, plastic, rubber, aluminum, or a synthetic impact resistant composition;

iii) said housing having ferrous rings secured around apertures placed within its surface;

iv) said housing having surface markings and guides printed thereon to assist the user;

c) an Impact Form comprising:

i) a housing comprised of structure designed to absorb the pressure of impact form a golf club with negligible permanent deformation;

ii) said housing material selected form the list of rubber, plastic vinyl, and fabric;

iii) said housing further comprises a ferrous element to allow the housing to be magnetically fastened to the Magnetic Module; and iv) said Impact Form optionally provided with a tether; and d) a Ball Holder comprising:

i) a receptacle housing means for holding a golf ball wherein said receptacle housing is made from commercially available items selected form a catch tip, cane tip, and chair leg bottom section, wherein said receptacle is molded to include a concave area on it's top section;

ii) said housing material selected form the list of rubber, plastic, and vinyl;

iii) said housing comprises a ferrous element to magnetically attach the Ball Holder to the Magnetic Module, and the Ball Holder is capable of fitting into a selected aperture of the Swing Plate; and iv) said Ball Holder optionally have a tether attached to it.

2. A Football kickoff and ball teeing device including the Magnetic Module of claim 1 comprising:

a) a housing having a flat base, wherein the base has a ferrous element, b) wherein the holder includes at least a pair of ball supporting legs and an optional additional leg for holding a football in proper kickoff position.

3. A Golf Ball putting, chipping, pitching device comprising the Magnetic Module of claim 1 including a Synthetic Grass Mat comprising:

a) a synthetic grass mat having a flat ferrous strip fixed to the back side of the mat; and b) means for fixing said ferrous strip selected from rivets, bolts, and nuts.

4. A Target Flag Holding device comprising the Magnetic Module of claim 1 further comprising:

a) cup-shaped ferrous housing for receiving a shaft; and i) a ferrous pipe cap; and ii) a ferrous cup shaped structure;

b) as shaft insertable into the cup that is made of wooden dowel or plastic.

* * * * *